US009190043B2

(12) United States Patent
Krisch et al.

(10) Patent No.: US 9,190,043 B2
(45) Date of Patent: Nov. 17, 2015

(54) ASSISTING CONVERSATION IN NOISY ENVIRONMENTS

(71) Applicant: Bose Corporation, Framingham, MA (US)

(72) Inventors: Kathleen S. Krisch, Sudbury, MA (US); Steven H. Isabelle, Newton, MA (US)

(73) Assignee: Bose Corporation, Framingham, MA (US)

( * ) Notice: Subject to any disclaimer, the term of this patent is extended or adjusted under 35 U.S.C. 154(b) by 262 days.

(21) Appl. No.: 14/011,161

(22) Filed: Aug. 27, 2013

(65) Prior Publication Data

US 2015/0063584 A1 Mar. 5, 2015

(51) Int. Cl.

| | |
|---|---|
| ***H04R 1/10*** | (2006.01) |
| ***G10K 11/00*** | (2006.01) |
| ***H04R 3/00*** | (2006.01) |

(52) U.S. Cl.

CPC ..... *G10K 11/002* (2013.01); *H04R 1/1083* (2013.01); *H04R 1/1091* (2013.01); *H04R 3/005* (2013.01)

(58) Field of Classification Search

CPC .. G10K 11/002; H04R 1/1091; H04R 1/1083; H04R 3/005

USPC ..... 381/334, 71.6

See application file for complete search history.

(56) References Cited

U.S. PATENT DOCUMENTS

| | | | | |
|---|---|---|---|---|
| 3,889,059 | A | 6/1975 | Thompson et al. | |
| 3,992,584 | A | 11/1976 | Dugan | |
| 3,999,015 | A * | 12/1976 | Snyder et al. | 379/171 |
| 4,600,208 | A | 7/1986 | Morishima | |
| 4,941,187 | A * | 7/1990 | Slater | 381/86 |
| 5,243,659 | A | 9/1993 | Stafford et al. | |
| 5,640,450 | A | 6/1997 | Watanabe | |
| 5,983,183 | A | 11/1999 | Tabet et al. | |
| 6,493,450 | B1 * | 12/2002 | Scheuer et al. | 381/57 |

(Continued)

FOREIGN PATENT DOCUMENTS

| | | |
|---|---|---|
| EP | 2555189 A1 | 2/2013 |
| JP | S57124960 A | 8/1982 |

(Continued)

OTHER PUBLICATIONS

International Search Report and Written Opinion dated Oct. 2, 2014 for International application No. PCT/US2014/049741.

(Continued)

*Primary Examiner* — Angel Castro

(57) ABSTRACT

A portable system for enhancing communication between at least two users in proximity to each other includes first and second noise-reducing headsets, each headset including an electroacoustic transducer for providing sound to a respective user's ear and a voice microphone for detecting sound of the respective user's voice and providing a microphone input signal. A first electronic device integral to the first headset and in communication with the second headset generates a first side-tone signal based on the microphone input signal from the first headset, generates a first voice output signal based on the microphone input signal from the first headset, combines the first side-tone signal with a first far-end voice signal associated with the second headset to generate a first combined output signal, and provides the first combined output signal to the first headset for output by the first headset's electroacoustic transducer.

21 Claims, 9 Drawing Sheets

(56) References Cited

U.S. PATENT DOCUMENTS

| | | | | |
|---|---|---|---|---|
| 7,065,198 | B2 | 6/2006 | Brown et al. | |
| 7,260,231 | B1 | 8/2007 | Wedge | |
| 7,620,419 | B1 | 11/2009 | Gandolfo | |
| 7,627,352 | B2 | 12/2009 | Gauger, Jr. et al. | |
| 8,139,744 | B2 | 3/2012 | Carlson et al. | |
| 8,208,650 | B2 | 6/2012 | Joho et al. | |
| 8,363,820 | B1 | 1/2013 | Graham | |
| 2002/0059064 | A1 | 5/2002 | Tabata et al. | |
| 2003/0118197 | A1 | 6/2003 | Nagayasu et al. | |
| 2005/0282592 | A1 | 12/2005 | Frerking et al. | |
| 2006/0293092 | A1 | 12/2006 | Yard et al. | |
| 2008/0037749 | A1 | 2/2008 | Metzger et al. | |
| 2008/0201138 | A1 | 8/2008 | Visser et al. | |
| 2009/0023417 | A1 | 1/2009 | Davis et al. | |
| 2010/0119077 | A1* | 5/2010 | Platz et al. | 381/72 |
| 2010/0150383 | A1 | 6/2010 | Sampat | |
| 2011/0033064 | A1* | 2/2011 | Johnson et al. | 381/94.1 |
| 2011/0044474 | A1 | 2/2011 | Grover et al. | |
| 2011/0135086 | A1 | 6/2011 | Sun et al. | |
| 2011/0288860 | A1 | 11/2011 | Schevciw et al. | |
| 2011/0293103 | A1 | 12/2011 | Park et al. | |
| 2012/0140941 | A1 | 6/2012 | Kuhtz et al. | |
| 2015/0063601 | A1* | 3/2015 | Briggs et al. | 381/110 |

FOREIGN PATENT DOCUMENTS

| | | | |
|---|---|---|---|
| WO | 9911045 | A1 | 3/1999 |
| WO | 9911047 | A1 | 3/1999 |
| WO | 2009097009 | A1 | 8/2009 |

OTHER PUBLICATIONS

International Search Report and Written Opinion dated Oct. 27, 2014 for International application No. PCT/US2014/049750.

* cited by examiner

| signal | label |
|---|---|
| voice audio input | V1, V2 |
| audio output | Out1, Out2 |
| microphone input signals | 211 |
| voice output signal | 213, 231 |
| side-tone signal | 215 |
| far-end voice signal | 213, 223, 233 |
| equalized voice output signal | 221 |
| content input signal | 311 |
| conversation output signal | 421 |
| combined output signal | 511 |

Fig. 10

ASSISTING CONVERSATION IN NOISY ENVIRONMENTS

BACKGROUND

This disclosure relates to assisting conversation, and in particular, to allowing two or more headset users near each other in a noisy environment to speak with ease and hear each other with ease.

Carrying on a conversation in a noisy environment, such as a factory floor, aircraft, or crowded restaurant can be very difficult. In particular, the person speaking has trouble hearing their own voice, and must raise it above what may be a comfortable level just to hear themselves, let alone for the other person to hear them. The speaker may also have difficulty gauging how loudly to speak to allow the other person to hear them. Likewise, the person listening must strain to hear the person speaking, and to pick out what was said. Even with raised voices, intelligibility and listening ease suffer. Additionally, speaking loudly can disturb others nearby, and reduce privacy.

Various solutions have been attempted to reduce these problems. Hearing aids intended for those with hearing loss may attempt to amplify the voice of a person speaking to the user while rejecting unwanted noise, but they suffer from poor signal-to-noise ratio due to limitations of the microphone being located at the ear of the listener. Also, hearing aids provide only a listening benefit, and do not address the discomfort of straining to speak loudly. Other communication systems, such as noise-canceling, intercom-connected headsets for use by pilots, may be quite effective for their application, but are tethered to the dashboard intercom, and are not suitable for use by typical consumers in social or mobile environments or, even in an aircraft environment, i.e., by commercial passengers.

SUMMARY

In general, in one aspect, a portable system for enhancing communication between at least two users in proximity to each other includes first and second noise-reducing headsets, each headset including an electroacoustic transducer for providing sound to a respective user's ear and a voice microphone for detecting sound of the respective user's voice and providing a microphone input signal. A first electronic device integral to the first headset and in communication with the second headset generates a first side-tone signal based on the microphone input signal from the first headset, generates a first voice output signal based on the microphone input signal from the first headset, combines the first side-tone signal with a first far-end voice signal associated with the second headset to generate a first combined output signal, and provides the first combined output signal to the first headset for output by the first headset's electroacoustic transducer.

Implementations may include one or more of the following, in any combination. The first electronic device may be coupled directly to the second headset, and the electronic device may generate a second side-tone signal based on the microphone input signal from the second headset, generate the first far-end voice signal based on the microphone input signal from the second headset, combine the second side-tone signal with the first voice output signal to generate a second combined output signal, and provide the second combined output signal to the second headset for output by the second headset's electroacoustic transducer. A second electronic device may be integral to the second headset, the first electronic device may be in communication with the second headset through the second electronic device, and the second electronic device may generate a second side-tone signal based on the microphone input signal from the second headset, generate a second voice output signal based on the microphone input signal from the second headset, provide the second voice output signal to the first electronic device as the first far-end voice signal, receive the first voice output signal from the first electronic device as a second far-end voice signal, combine the second side-tone signal with the second far-end voice signal to generate a second combined output signal, and provide the second combined output signal to the second headset for output by the second headset's electroacoustic transducer. A second electronic device may be integral to the second headset, the first electronic device may be in communication with the second headset through the second electronic device, the second electronic device may transmit the microphone input signal from the second headset to the first electronic device, while the first electronic device generates a second side-tone signal based on the microphone input signal from the second headset, generates a second voice output signal for use as the first far-end voice signal based on the microphone input signal from the second headset, combines the second side-tone signal with the first voice output signal as a second far-end voice signal to generate a second combined output signal, and transmits the second combined output signal to the second electronic device, and the second electronic device may be configured to receive the second combined output signal and provide it to the second headset for output by the second headset's electroacoustic transducer.

The voice microphone of the first headset and the first electronic device may be configured to generate the first microphone input signal by rejecting surrounding noise while detecting the respective user's voice. The first and second headsets may each include a noise cancellation circuit including a noise cancellation microphone for providing anti-noise signals to the respective electroacoustic transducer based on the noise cancellation microphone's output, and the first electronic device may be configured to provide the first combined output signal to the first headset for output by the first headset's electroacoustic transducer in combination with the anti-noise signals provided by the first headsets's noise cancellation circuit. The first and second headsets may each include passive noise reducing structures. Generating the first side-tone signal may include applying a frequency-dependent gain to the microphone input signal from the first headset. Generating the first side-tone signal may include filtering the microphone input signal from the first headset and applying a gain to the filtered signal. The first electronic device may control gains applied to the first side-tone signal and the first voice output signal. The first electronic device may control gains applied to the first side-tone signal and the first far-end voice signal when generating the first combined output signal. The first electronic device may control the gains applied to the signals under the direction of a user of the first headset. The first electronic device may control the gains applied to the signals automatically. The first electronic device may control gains applied to the first side-tone signal and the first voice output signal, and control a further gain applied to the first far-end voice signal.

A third noise-reducing headset may be involved, the third headset including an electroacoustic transducer for providing sound to a respective user's ear, and a voice microphone for detecting sound of the respective user's voice and providing a microphone input signal. A second electronic device may be integral to the second headset, and a third electronic device integral to the third headset, with the first electronic device in communication with the second and third headsets through the respective second and third electronic devices, and the far-end voice signal received by the first electronic device may includes voice output signals from both the second and third headsets. The first far-end voice signal received by the first electronic device may include the first voice output signal, and the first device may remove the first voice output signal from the first far-end voice signal before combining the first far-end voice signal with the first side-tone signal to generate the first combined output signal.

The first electronic device may be in communication with the third headset through the third electronic device, and the third electronic device may generate a third side-tone signal based on the microphone input signal from the third headset, generate a third voice output signal based on the microphone input signal from the third headset, transmit the third voice output signal to the first and second electronic devices for use as the first and second far-end voice signals, receive the first voice output signal from the first electronic device and the second voice output signal from the second electronic device, combine the third side-tone signal with the first and second voice output signals as far-end voice signals to generate a third combined output signal, and provide the third combined output signal to the third headset for output by the third headset's electroacoustic transducer. The second electronic device may be in communication with the third headset through the third electronic device. The second electronic device may be in communication with the third headset through the third electronic device by way of the first electronic device.

In general, in one aspect, a noise-reducing headset for use in a portable system for enhancing communication between at least two users in proximity to each other includes an electroacoustic transducer for providing sound to a user's ear, a voice microphone for detecting sound of the user's voice and providing a microphone input signal, and an electronic circuit integral to the headset and including an interface for communication with a second headset. The electronic device generates a first side-tone signal based on the microphone input signal, generate a first voice output signal based on the microphone input signal, combine the first side-tone signal with a first far-end voice signal associated with the second headset to generate a first combined output signal, and provide the first combined output signal to the transducer for output.

Implementations may include one or more of the following, in any combination. The electronic circuit may apply gains to the first side-tone signal and the first voice output signal. The electronic circuit may apply gains to the first side-tone signal and the first far-end voice signal when generating the first combined output signal.

Advantages include allowing users to engage in conversation in a noisy environment, including hearing their own voice, being heard by their conversation partners, and hearing their partners' voices, all without straining to hear or to speak, and without disturbing others.

All examples and features mentioned above can be combined in any technically possible way. Other features and advantages will be apparent from the description and the claims.

BRIEF DESCRIPTION OF THE DRAWINGS

FIG. 10 is a table listing signals referred to in describing FIGS. 3 through 9.

DESCRIPTION

Figure 1:
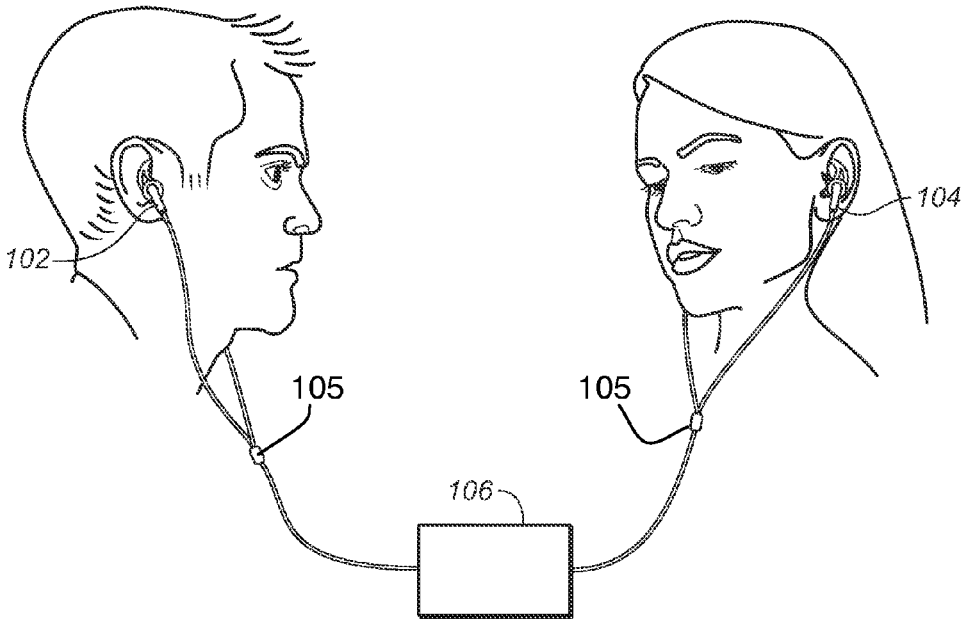
FIGS. 1 through 3 show configurations of headsets and electronic devices used in conversations.

A system for allowing two or more headset users near each other in a noisy environment to speak with ease and hear each other with ease includes two headsets and at least one electronic device in communication with both headsets, as shown in FIG. 1. Each headset 102, 104 isolates a user from ambient noise; this may be done passively, through acoustic structures, or actively, through the inclusion of an active noise reduction (ANR) system. An active noise reduction system will generally work in conjunction with passive noise reduction features. Each headset also includes a voice microphone 105 for detecting the speech of its own user. In some examples, the voice microphone is also used as part of the ANR system, such as a feed-forward microphone detecting ambient sounds or a feed-back microphone detecting sound in the user's ear canal. In other examples, the voice microphone is a separate microphone optimized for detecting the user's speech and rejecting ambient noise, such as a boom microphone or a microphone array configured to be sensitive to sound coming from the direction of the user's mouth. Each headset provides its voice microphone output signal to an electronic device 106.

Figure 2:
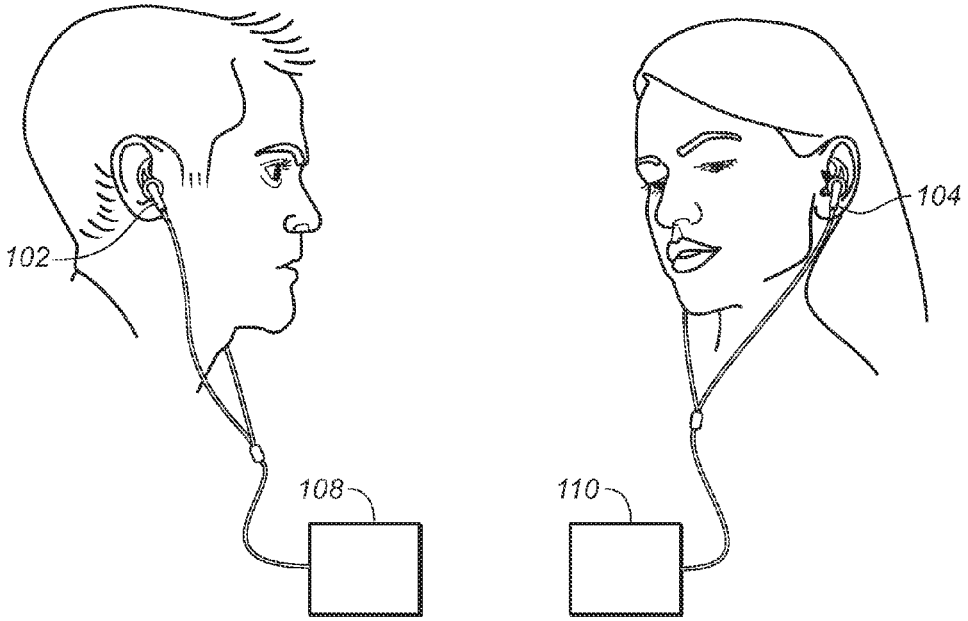
Figure 3:
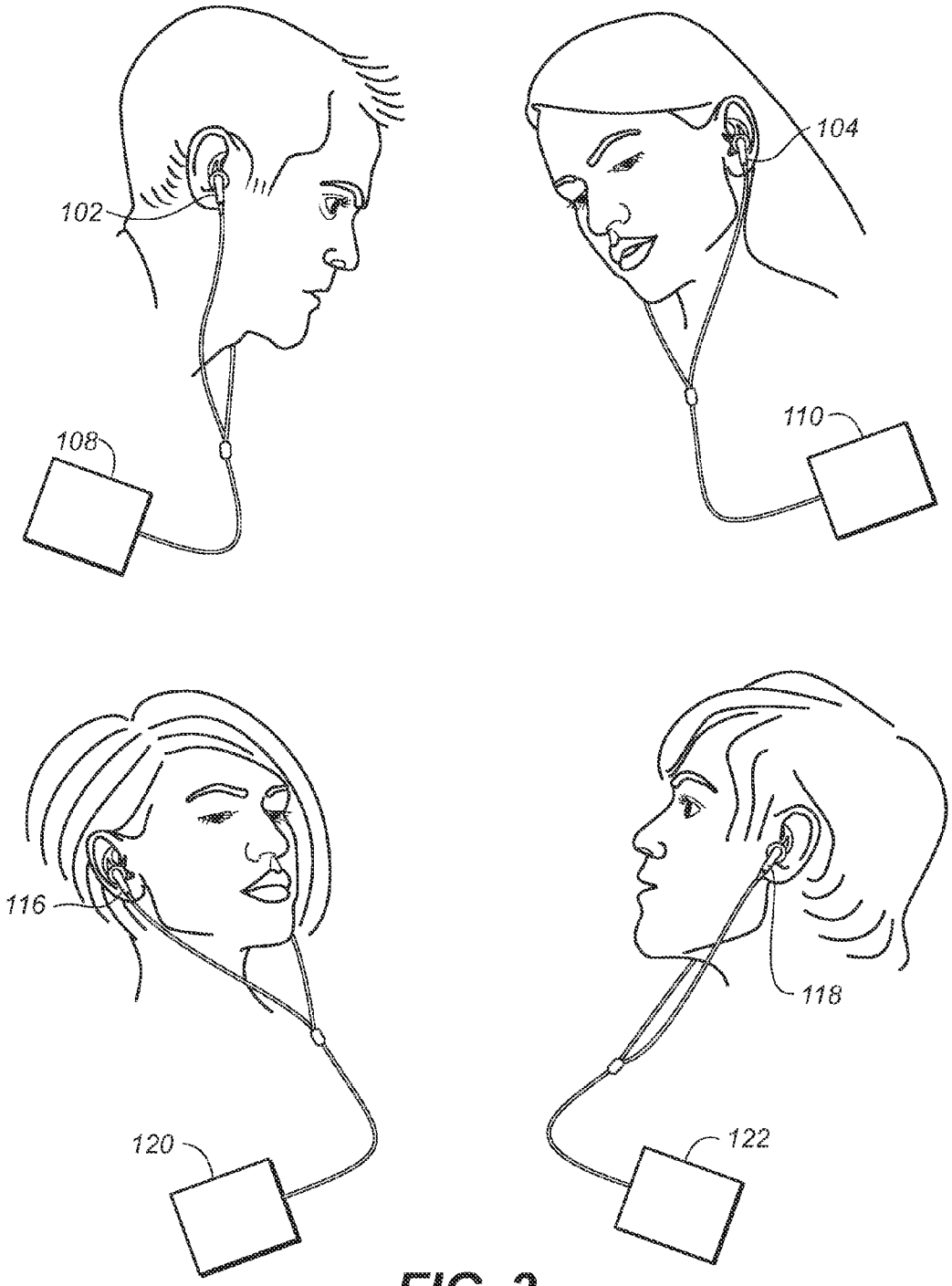

In some examples, as shown in FIGS. 2 and 3, each headset is connected to a separate electronic device, i.e., devices 108 and 110 in FIG. 2. In FIG. 3, four users are shown having a conversation, each user with a headset 102, 104, 116, 118 connected to a respective electronic device 108, 110, 120, 122. A multi-way conversation may also use a single electronic device, such as device 106 in FIG. 1, or two or more (but fewer than the number of headsets) devices that each communicate with a subset of the headsets and with each other. In some examples, the electronic devices are fully integrated into the headsets. The processing described below as taking place in two or more circuits may be performed in each of the distributed devices from FIGS. 2 and 3, or all in one device such as the common device in FIG. 1 or in one of the distributed devices to generate signals for re-distribution back to the other distributed device, or in any practical combination.

Although the headsets are shown as connected to the electronic devices by wires, the connection could be wireless, using any suitable wireless communication method, such as Bluetooth®, WiFi, or a proprietary wireless interface. In addition to the headsets, the electronic devices may be in communication with each other using wired or wireless connections. The wireless connections used for communication between the electronic devices may be different than that used with the headsets. For example, the headsets may use Bluetooth to communicate with their respective electronic devices, while the electronic devices use WiFi to communicate with each other. The electronic devices may also use more than one method simultaneously to communicate with each other. Throughout this application, we refer to various acoustic and electronic signals flowing within and between headsets and electronics. The names of the signals and their references in the figures are listed in FIG. 10 for reference.

Figure 4:
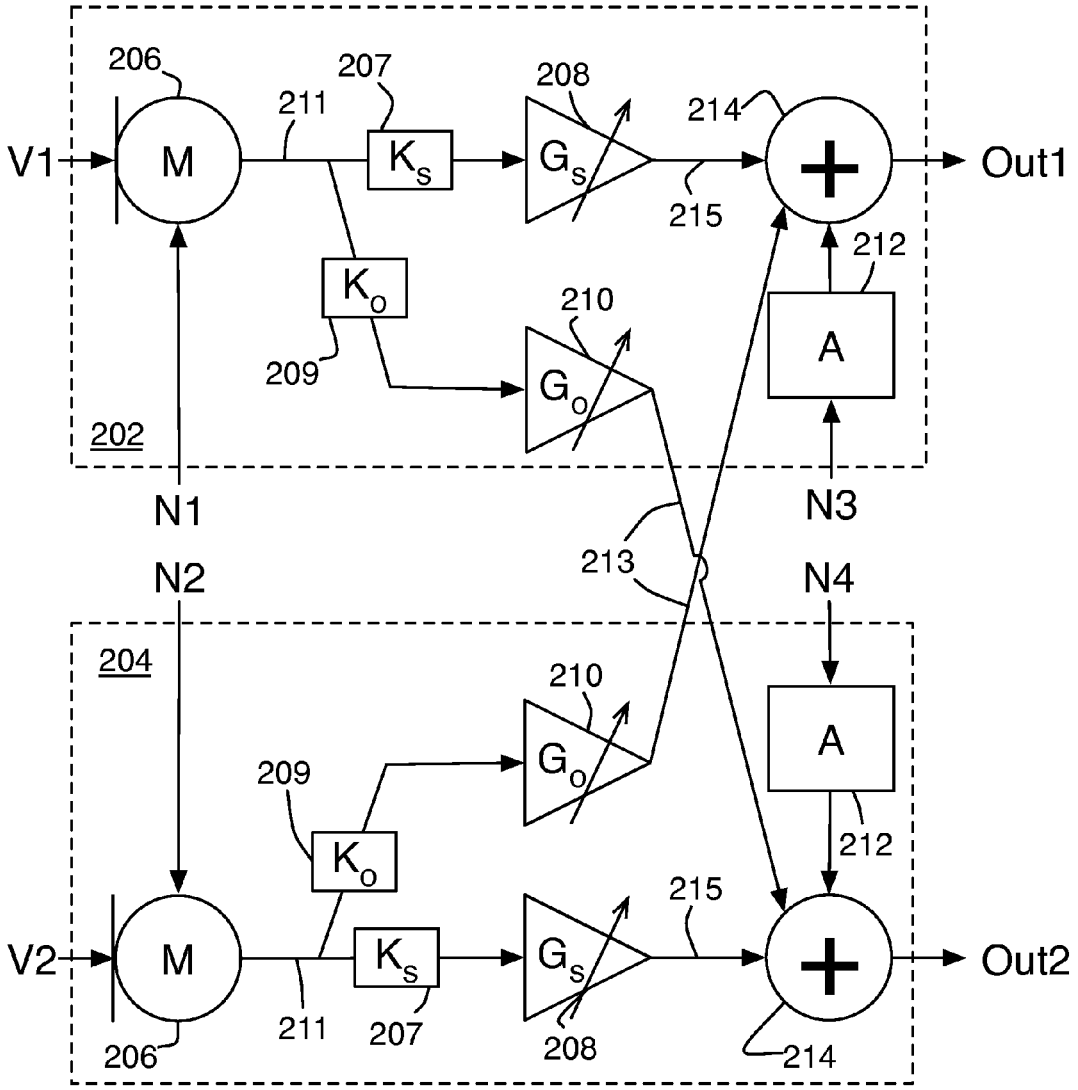
FIGS. 4 through 8 show circuits for implementing the devices of FIGS. 1 through 3.

In the electronic device or devices, the voice microphone signals from each headset are handled in two different ways, as shown in FIG. 4. Two identical systems 202 and 204 are shown in FIG. 4, which may include circuits in each of the electronic devices of FIGS. 2 and 3, or circuitry within a single electronic device as in FIG. 1. The systems also include acoustic elements, including the attenuation of the headsets, as discussed below. The circuit component may be implemented with discrete electronics, or may be implemented by software code running on a DSP or other suitable processor within the electronic device or devices.

Each system includes a voice microphone 206 receiving a voice audio input V1 or V2, a first equalization stage 207, a first gain stage 208, a second equalization stage 209, a second gain stage 210, an attenuation block 212, and an output summation node 214 providing an audio output Out1 or Out2. The voice audio inputs V1 and V2 represent the actual voice of the user, and the audio outputs Out1 and Out2 are the output acoustic signals heard by the users. The microphones 206 also detect ambient noise N1 and N2 and pass that on to the gain stages, filtered according to the microphone's noise rejection capabilities. The microphones are more sensitive to the voice input than to ambient noise, by a noise rejection ratio M. The combined signals 211 from the microphones, V1+N1/M and V2+N2/M, may be referred to as microphone input signals. Within those signals, N1/M and N2/M represent unwanted background noise. Different ambient noise signals N1 and N2 are shown entering the two systems, but depending on the distance between the users and the acoustic environment, the noises may be effectively the same. Ambient noises N3 and N4 at the users ears, which may also be the same as N1 or N2, are attenuated by the attenuation block 212 in each system, which represents the combined passive and active noise reduction capability, if any, of the headsets. The resulting residual noise is shown entering the output summation node, though in actual implementation, the electronic signals are first summed and output by the output transducer, and the output of the transducer is acoustically combined with the residual noise within the user's ear canal. That is, the output summation node 214 represents the output transducer in combination with its acoustic environment, as shown in more detail in FIG. 9.

The two circuits 202 and 204 apply the same processing to the two microphone input signals. First, each microphone input signal is filtered by the first equalization stage 207, which applies a filter $K_s$, and amplified by the first gain stage 208, which applies a gain G. The filter $K_s$ and gain $G_s$ change the shape and level of the voice signal to optimize it for use as a side-tone signal. When a person cannot hear his own voice, such as in loud noise, he will tend to speak more loudly. This has the effect of straining the speaker's voice. On the other hand, if a person in a noisy environment is wearing noise isolating or noise canceling headphones, he will tend to speak at a comfortable, quieter level, but also will suffer from the occlusion effect, which inhibits natural, comfortable speaking. The occlusion effect is the change in how a person's voice sounds to themselves when the ear is covered or blocked. For example, occlusion may produce low-frequency amplification, and cause a person's voice to sound unnatural to themselves. A side-tone signal is a signal played back to the ear of the speaker, so that he can hear his own voice. If the side-tone signal is appropriately scaled, the speaker will intuitively control the level of his voice to a comfortable level, and be able to speak naturally. The side-tone filter $K_s$ shapes the voice signal to compensate for the way the occlusion effect changes the sound of a speaker's voice when his ear is plugged, so that in addition to being at the appropriate level, the side-tone signal sounds, to the user, like his actual voice sounds when not wearing a headset.

The microphone input signal 211 is also equalized and scaled by the second filter 209 and gain stage 210, applying a voice output filter $K_o$ and a voice output gain $G_0$. The voice output filter and gain are selected to make the voice signal from one headset's microphone audible and intelligible to the user of the second headset, when played back in the second headset. The filtered and scaled voice output signals 213 are each delivered to the other headset, where they are combined with the filtered and scaled side-tone signals 215 within each headset to produce a combined audio output Out1 or Out2. When discussing one headset, we may refer to the voice output signal 213 from the other headset, played back by the headset under consideration, as the far-end voice signal. As mentioned above, the microphones 206 pick up ambient noise N1 and N2, and deliver that to the filter and gain stages along with voice signals V1 and V2. Ambient noise N3 and N4 are attenuated by noise reduction features of the headsets, whether active or only passive, shown as attenuation blocks A, such that an attenuated noise signal A•N3 or A•N4 is heard in each headset, along with the combined side-tone signal 215 and far-end voice signal 213 (i.e., the voice output signal from the other headset), the side-tone signal and far-end voice signal each including the unwanted background noise N1/M and N2/M from their respective microphones.

The gain $G_s$ is selected, taking into consideration the noise rejection capabilities of the voice microphones and the noise attenuation capabilities of the headsets, to provide the side-tone signal at a level that will allow the user to hear his own voice over the residual noise and naturally speak at a comfortable level. At the same time, the gain $G_o$ is selected, taking the same factors into account, to provide the voice output signals to each headset at a level that will allow each user to hear the other user's voice at a comfortable and intelligible level. In some examples, the gain $G_s$ is set to balance the user's own comfort, by providing an appropriate side-tone level, with making sure the user speaks loudly enough for the voice microphone to detect the speaker's voice with enough signal-to-noise (SNR) ratio to provide a useful voice signal. The circuits shown in FIG. 4 produce complementary audio outputs, $Out1=K_sG_s(V1+N1/M)+A\bullet N3+K_0G_o(V2+N2/M)$ and $Out2=K_sG_s(V2+N2/M)+A\bullet N4+K_oG_o(V1+N1/M)$. FIG. 4 assumes that the two headsets are the same model, with the same pre-set filters, gains, ambient noise attenuation, and microphone responses. The filters $K_s$ and $K_o$ and gains $G_s$ and $G_o$ may be empirically determined based on the actual acoustics of the headset in which this circuit is implemented and the sensitivity of the microphones. A user control may also be provided, to allow the user to compensate for their own hearing abilities by adjusting the side-tone gain or filter up or down. To simplify later drawings, the filters and corresponding gains are simplified into common equalization/amplification blocks, and only the gain term G is shown in the drawings, though we still include the filter term K in equations. It should be understood that any gain block may include equalization applying a filter corresponding to the labeled gain. The filters are only separated out and discussed where their operation is independent of an associated gain term.

Figure 5:
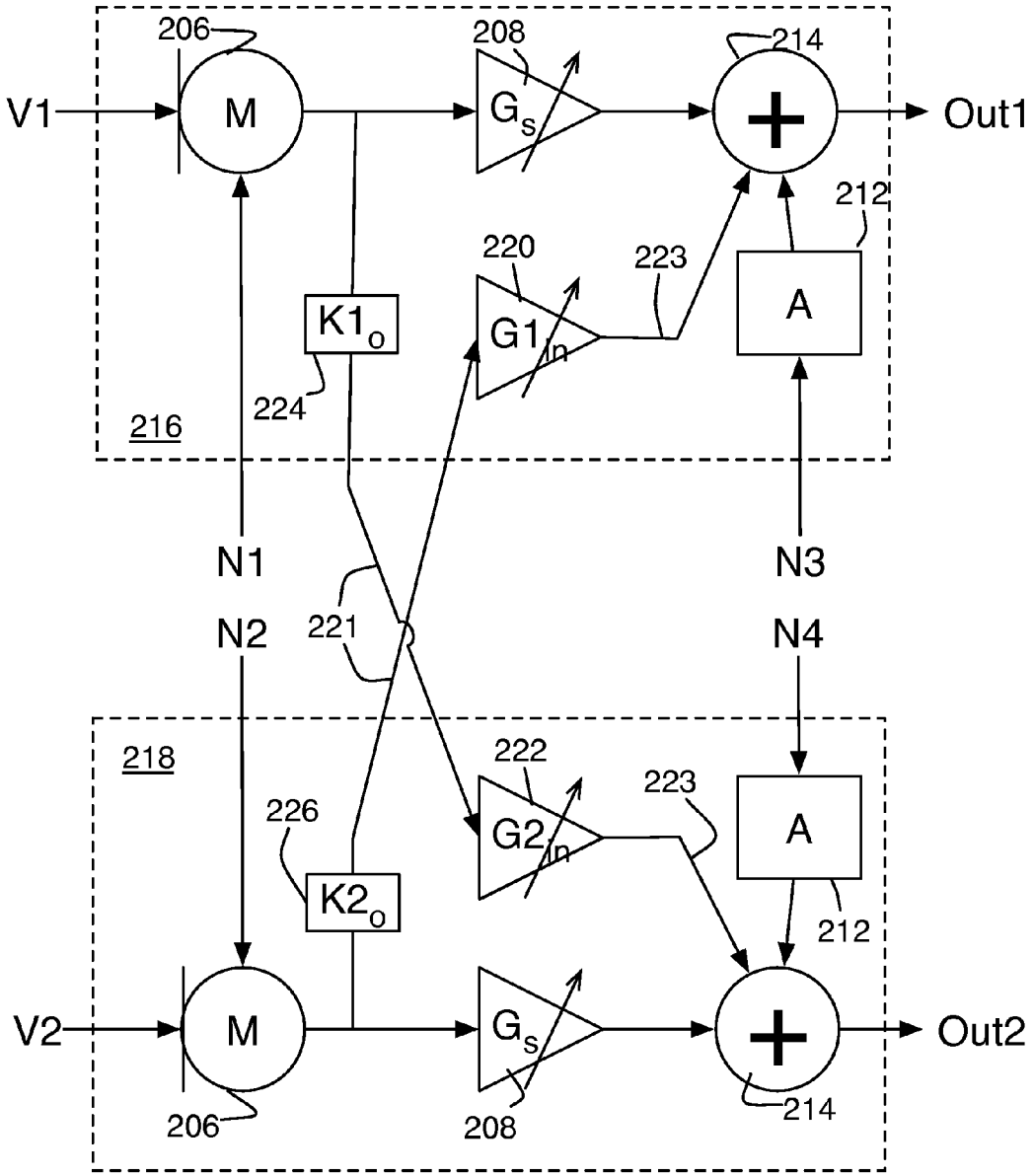

FIG. 5 shows a variation on the circuit of FIG. 4, with circuits 216 and 218 each transmitting an equalized voice output signal 221, with value $Ki_o(Vi+Ni/M)$, to the other circuit before a gain $G1_{in}$ or $G2_{in}$ is applied at gain blocks 220 and 222 to produce the far-end voice signal 223, instead of a gain $G_o$ being applied before transmission. The voice output filters 224 and 226 remain with the source device, filtering the microphone input signals based on the properties of the corresponding microphone, but are shown as possibly being different between devices. This separation allows the user to adjust the gain of the far-end voice signal to compensate for their own hearing abilities or local variations in noise in the same manner as the side-tone gain adjustment mentioned above. The default values of the gains $G1_{in}$ and $G2_{out}$ may also be different, if the headsets are different models with different responses. In FIG. 5, the gains of the voice input gain blocks 220 and 222 are numbered $G1_{in}$ and $G2_{in}$, and the filters of the voice output equalization blocks 224 and 226 are numbered $K1_o$ $K2_o$ to indicate that they may be different (note that the output filters and gains may also be different in the example of FIG. 4). The side-tone filters $K1_s$ and $K2_s$ (not shown in the figure) are also different, such that the audio output will be $Out1=K1_sG1_s(V1+N1/M)+A\bullet N3+K2_oG1_{in}(V2+N2/M)$ and $Out2=K2_sG2_s(V2+N2/M)+A\bullet N4+K1_oG2_{in}(V1+N1/M)$.

Figure 6:
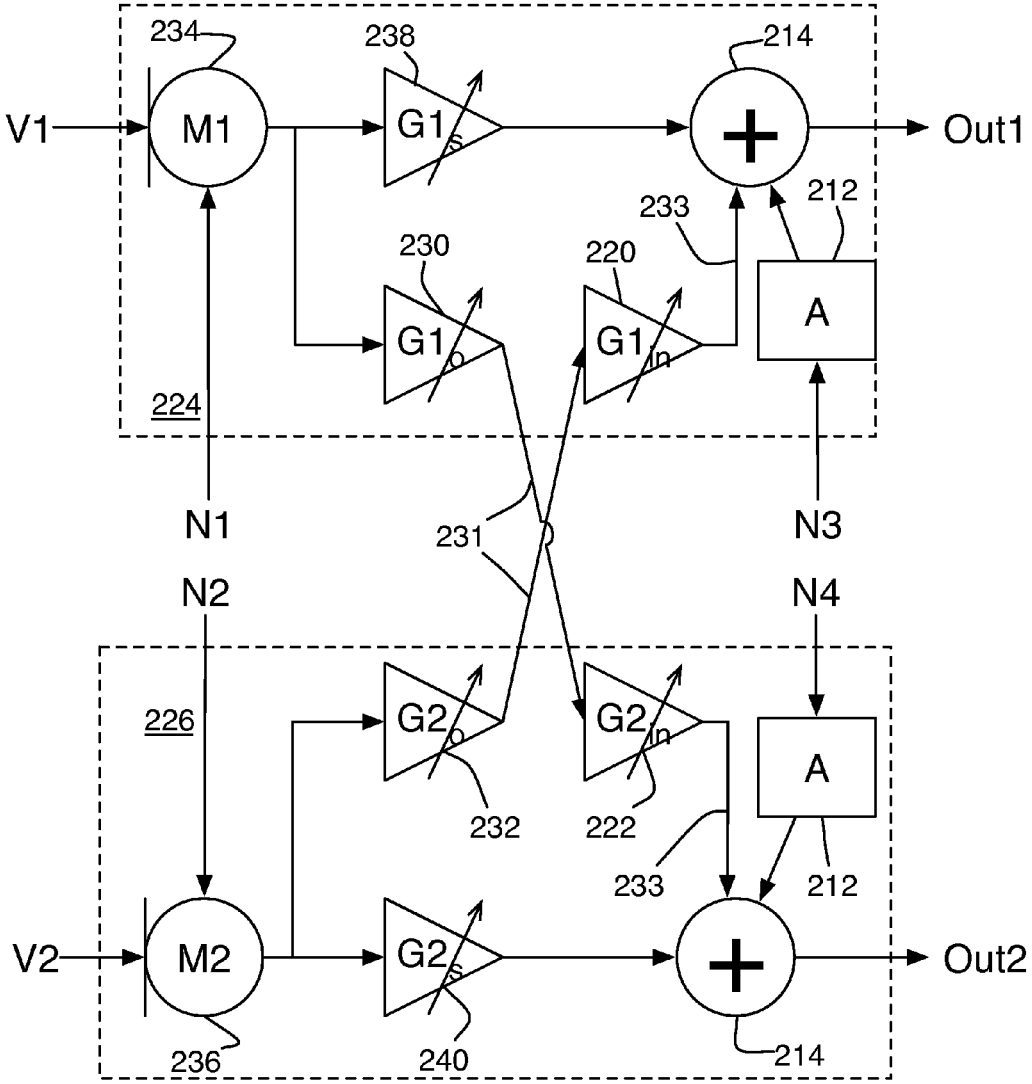

The examples of FIGS. 4 and 5 may be combined, with gain applied to the voice output signal at both the headset generating it and the headset receiving it. This is shown in FIG. 6, with circuits 224 and 226 each containing an individualized output gain stage 230, 232 and an individualized input gain stage 220, 222. Filters are not shown. Applying gain at both ends allows the headset generating the voice signal to apply a gain $Gi_o$ based on knowledge of the acoustics of that headset's microphone, and the headset receiving the signal to apply an additional gain (or attenuation) $Gi_{in}$ based on knowledge of the acoustics of that headset's output section and the user's preference. In this case, as in FIG. 5, the voice output signal 231 sent between headsets will be different from the far-end voice signal 233 provided to the output. For completeness, the microphone noise rejection and side-tone gains are also individualized in microphones 234 and 236 and gain stages 238 and 240. In this case, the audio outputs are $Out1=G1_s(V1+N1/M1)+A\bullet N3+G2_o\bullet G1_{in}(V2+N2/M2)$ and $Out2=G2_s(V2+N2/M2)+A\bullet N4+G1_o\bullet G2_{in}(V1+N1/M1)$.

Figure 7:
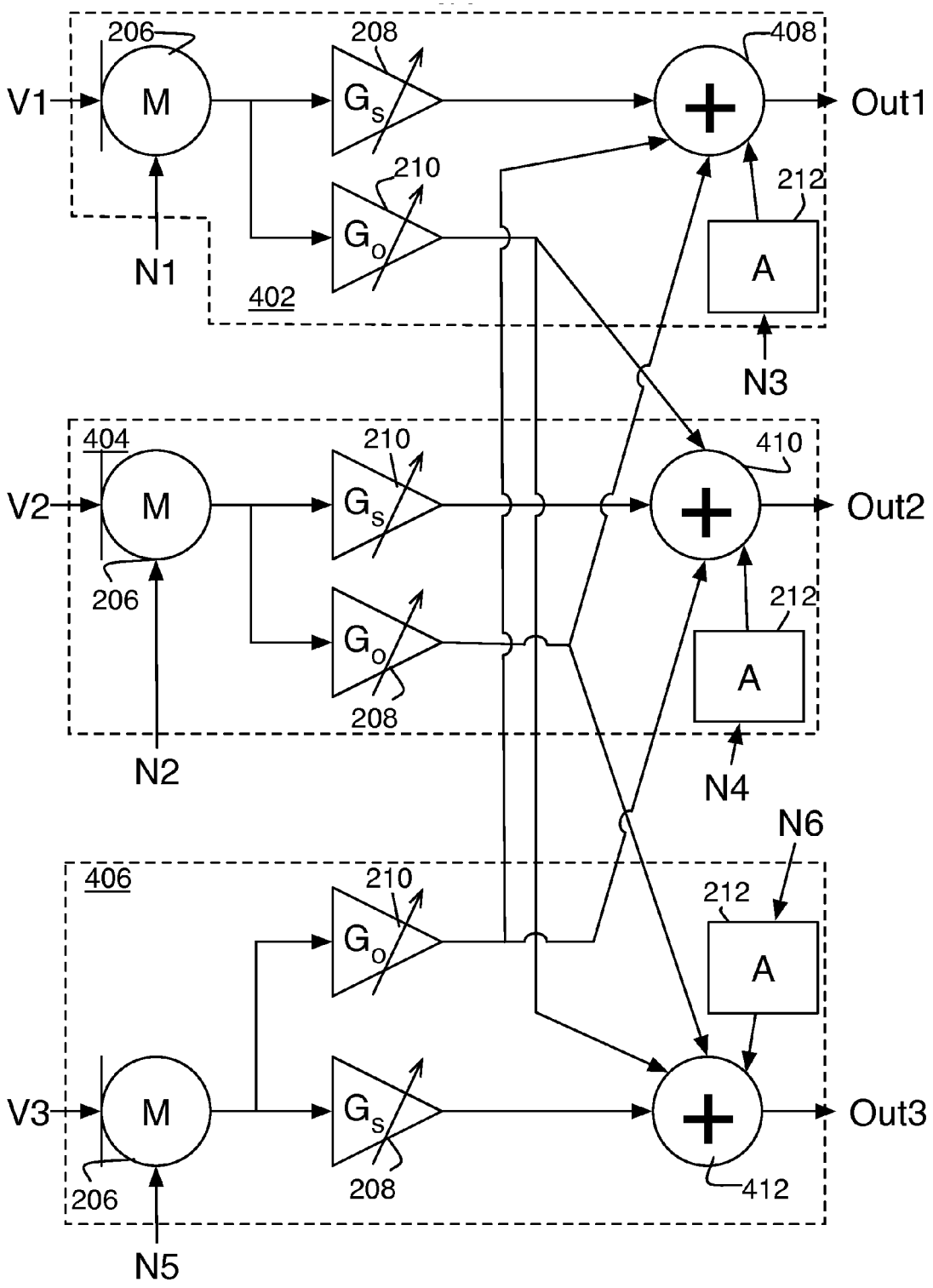

In some examples, as shown in FIG. 7, the system is extended to have three or more headset users sharing in a conversation. As with FIG. 6, the systems 402, 404, and 406 in FIG. 7 uses the simple headset circuits of FIG. 4, but could also be implemented with the circuits of FIG. 5 or 6 to provide the additional features of those circuits. As shown, each of the voice output signals $G_o(Vi+Ni/M)$ is provided to each of the other headset circuits. The circuits are the same as FIG. 4, except that the summation nodes 408, 410, and 412 have more inputs. At each headset circuit, the local side-tone signals $G_s(Vi+Ni/M)$ are combined with all the far-end voice signals to produce the respective audio output.

Figure 8:
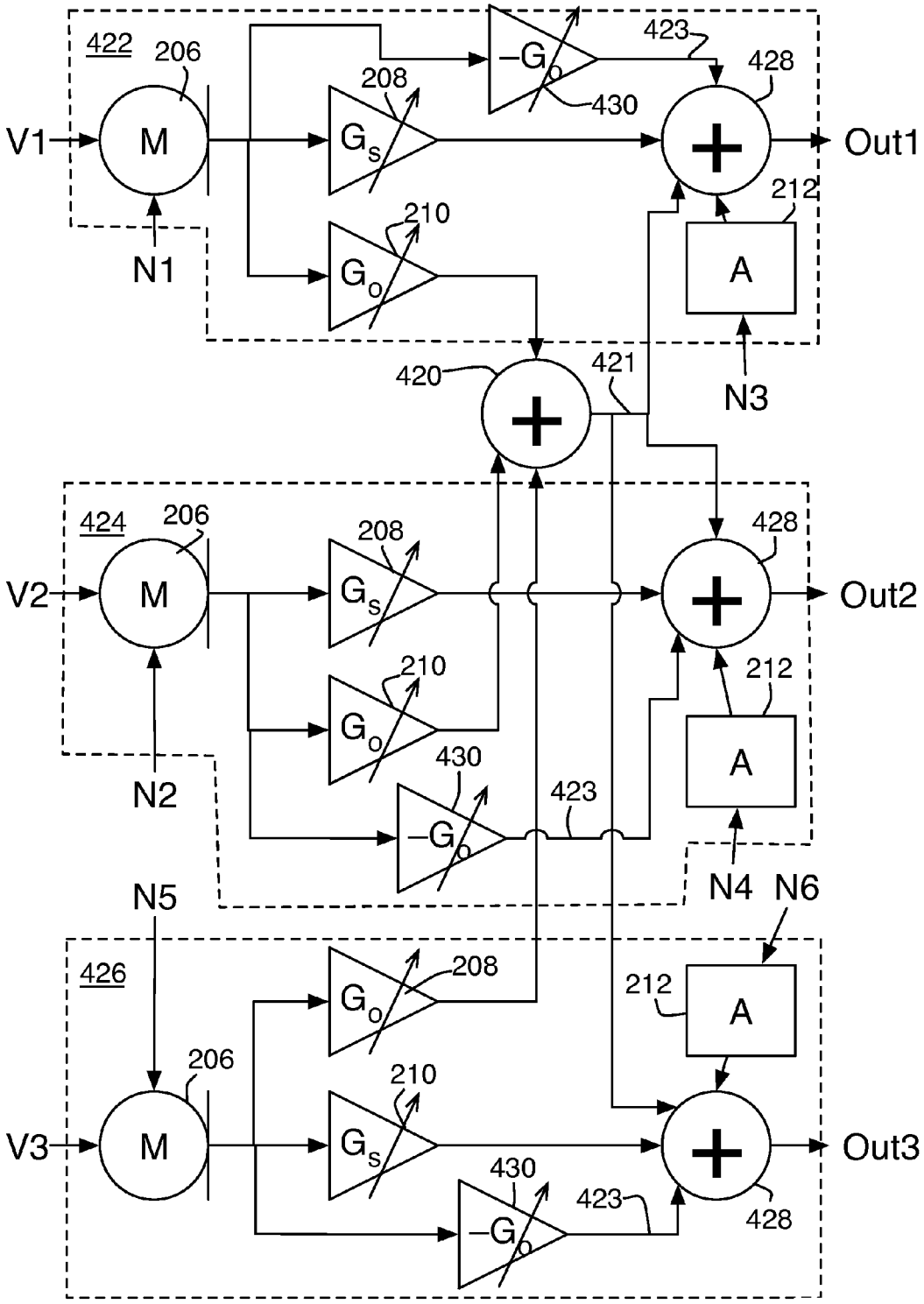

As can be seen in FIG. 7, even with the simple circuits from FIG. 4 all applying the same gains, adding additional users increases the complexity of the system, because an increasing number of far-end voice signals in each headset are mixed to form each audio output. This can be simplified by combining the side-tone and voice output signals, i.e., by making $G_s=G_o$, so that all the voice output signals can be combined once, and provided to each headset, with the combined signal including each headset's user's own voice as a side-tone. Doing this, however, would require a very low latency communication and processing system, so that the transmitted, combined, and received copy of a user's own voice remains close enough in time to the original vocalization as to not confuse the user (hearing one's own voice reproduced a few milliseconds late is very disconcerting). An alternative, shown in FIG. 8, is to maintain the local side-tone signals while combining all voice output signals at a summing node 420 into a common conversation output signal 421. Each headset circuit 422, 424, 426 then subtracts a suitably delayed and scaled copy 423 of the microphone input signal from the common voice signal, at its own summing node 428, removing the user's own voice from the common signal. If all the headsets are applying the same gain $G_o$ to their output voice signal, the appropriate gain to use for subtracting the local voice signal is simply $-G_o$, applied by a gain stage 430 that can be the same in each headset. The delay may also be determined a priori and built into the gain stage 430, if the communication system used to share the voice output signals is sufficiently understood and repeatable, or it may be determined on the fly by an appropriate adaptive filter. With this implementation, an unlimited number of headsets can be used without increasing the complexity of each headset—only the device summing all the voice output signals needs to increase in complexity.

Figure 9:
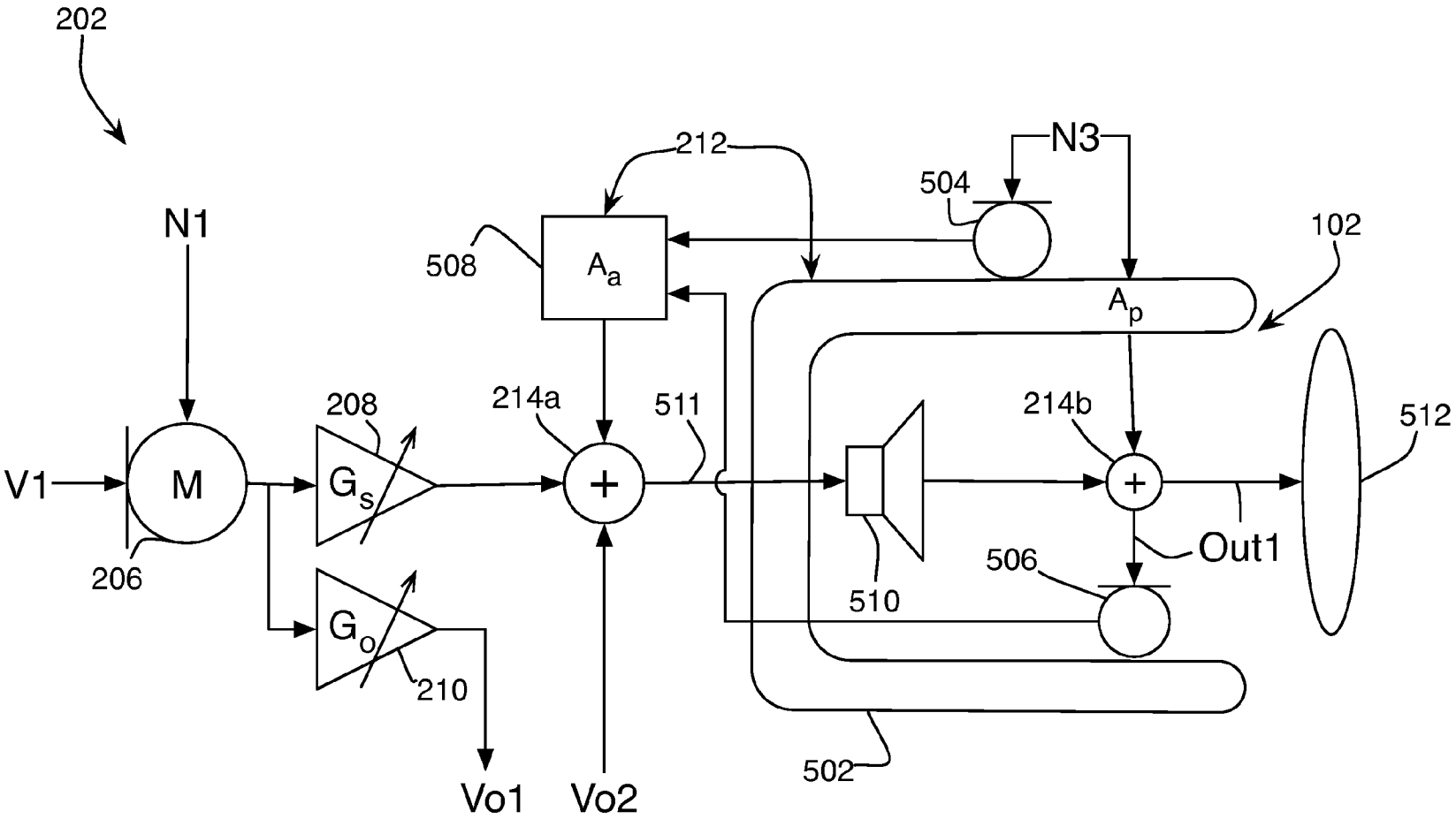
FIG. 9 shows a more detailed implementation of the circuit of FIG. 4.

FIG. 9 shows a more detailed view of the system 202 from FIG. 4, including an example of the noise cancellation circuit abstracted as attenuation block 212 and the electro-acoustic system abstracted as summing node 214 in FIG. 4. The same noise cancellation circuitry and acoustic system may be applied to the corresponding circuits in any of FIGS. 5 through 8. The attenuation block 212 includes a passive attenuation element 502, which represents the physical attenuation provided by the headset structures such as the ear cup in an around-ear headphone or housing and ear tip in an in-ear headphone and applies an attenuation $A_p$ to noise N3. The attenuation block 212 may also encompass an active noise reduction circuit 508 connected to one or both of a feed-forward microphone 504 and a feed-back microphone 506. The microphones provide noise signals to the ANR circuit 508, which applies an active noise reduction filter to generate anti-noise sounds to be played back by the output transducer 510 of the headset 102. We represent the active attenuation as having value $A_a$. The acoustic structures and electronic circuitry for such an ANR system are described in U.S. patent application Ser. No. 13/480,766 and Publication 2010/02702277, both incorporated here by reference.

The electronic signals to be output, which include the side-tone signal $G_s(V1+N1/M)$, far-end voice signal (voice output signal Vo2 from the other headset), and anti-noise signal $A_a\bullet N3$, are summed electronically to produce a combined output signal 511 at the input 214*a* of the output electroacoustic transducer 510. The acoustic output of the transducer is then summed acoustically with the residual noise $A_p\bullet N3$ penetrating the headphone, represented as an acoustic sum 214*b*, to form the audio output Out1 referred to in earlier figures. The combined acoustic signals of the audio output are detected by both the feed-back microphone 506 and the eardrum 512.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. A portable system for enhancing communication between at least two users in proximity to each other, comprising:

first and second noise-reducing headsets, each headset comprising:

an electroacoustic transducer for providing sound to a respective user's ear, and a voice microphone for detecting sound of the respective user's voice and providing a microphone input signal; and a first electronic device integral to the first headset and in communication with the second headset, configured to:

generate a first side-tone signal based on the microphone input signal from the first headset, generate a first voice output signal based on the microphone input signal from the first headset, receive a first far-end voice signal from the second headset, combine the first side-tone signal with the first far-end voice signal to generate a first combined output signal, and provide the first combined output signal to the first headset for output by the first headset's electroacoustic transducer, wherein the first and second headsets each include a noise cancellation circuit including a noise cancellation microphone for providing anti-noise signals to the respective electroacoustic transducer based on the noise cancellation microphone's output, and the first electronic device is configured to provide the first combined output signal to the first headset for output by the first headset's electroacoustic transducer in combination with the anti-noise signals provided by the first headset's noise cancellation circuit.

2. The system of claim 1 wherein the first electronic device is coupled directly to the second headset, and the electronic device is further configured to:

generate a second side-tone signal based on the microphone input signal from the second headset, generate the first far-end voice signal based on the microphone input signal from the second headset, combine the second side-tone signal with the first voice output signal to generate a second combined output signal, and provide the second combined output signal to the second headset for output by the second headset's electroacoustic transducer.

3. The system of claim 1 further comprising a second electronic device integral to the second headset, wherein the first electronic device is in communication with the second headset through the second electronic device, and the second electronic device is configured to:

generate a second side-tone signal based on the microphone input signal from the second headset, generate a second voice output signal based on the microphone input signal from the second headset, provide the second voice output signal to the first electronic device as the first far-end voice signal, receive the first voice output signal from the first electronic device as a second far-end voice signal, combine the second side-tone signal with the second far-end voice signal to generate a second combined output signal, and provide the second combined output signal to the second headset for output by the second headset's electroacoustic transducer.

4. The system of claim 1 further comprising a second electronic device integral to the second headset, wherein the first electronic device is in communication with the second headset through the second electronic device, the second electronic device is configured to transmit the microphone input signal from the second headset to the first electronic device, the first electronic device is configured to:

generate a second side-tone signal based on the microphone input signal from the second headset, generate a second voice output signal for use as the first far-end voice signal based on the microphone input signal from the second headset, combine the second side-tone signal with the first voice output signal as a second far-end voice signal to generate a second combined output signal, and transmit the second combined output signal to the second electronic device, and the second electronic device is configured to receive the second combined output signal and provide it to the second headset for output by the second headset's electroacoustic transducer.

5. The system of claim 1 wherein the voice microphone of the first headset and the first electronic device are configured to generate the first microphone input signal by rejecting surrounding noise while detecting the respective user's voice.

6. The system of claim 1, wherein the first and second headsets each include passive noise reducing structures.

7. The system of claim 1 wherein generating the first side-tone signal includes applying a frequency-dependent gain to the microphone input signal from the first headset.

8. The system of claim 1 wherein generating the first side-tone signal includes filtering the microphone input signal from the first headset and applying a gain to the filtered signal.

9. The system of claim 1 wherein the first electronic device is further configured to control gains applied to the first side-tone signal and the first voice output signal.

10. The system of claim 1 wherein the first electronic device is further configured to control gains applied to the first side-tone signal and the first far-end voice signal when generating the first combined output signal.

11. The system of claim 10 wherein the first electronic device controls the gains applied to the signals under the direction of a user of the first headset.

12. The system of claim 10 wherein the first electronic device controls the gains applied to the signals automatically.

13. The system of claim 1 wherein the first electronic device is further configured to control gains applied to the first side-tone signal and the first voice output signal, and to control a further gain applied to the first far-end voice signal.

14. They system of claim 1, further comprising:

a third noise-reducing headset, the third headset comprising:

an electroacoustic transducer for providing sound to a respective user's ear, and a voice microphone for detecting sound of the respective user's voice and providing a microphone input signal;

a second electronic device integral to the second headset; and a third electronic device integral to the third headset;

wherein the first electronic device is in communication with the second and third headsets through the respective second and third electronic device, and the far-end voice signal received by the first electronic device includes voice output signals from both the second and third headsets.

15. A portable system for enhancing communication between at least two users in proximity to each other, comprising:

first and second noise-reducing headsets, each headset comprising:

an electroacoustic transducer for providing sound to a respective user's ear, and a voice microphone for detecting sound of the respective user's voice and providing a microphone input signal;

a first electronic device integral to the first headset and in communication with the second headset, configured to:

generate a first side-tone signal based on the microphone input signal from the first headset, generate a first voice output signal based on the microphone input signal from the first headset, receive a first far-end voice signal from the second headset, combine the first side-tone signal with the first far-end voice signal to generate a first combined output signal, and provide the first combined output signal to the first headset for output by the first headset's electroacoustic transducer;

a third noise-reducing headset, the third headset comprising:

an electroacoustic transducer for providing sound to a respective user's ear, and a voice microphone for detecting sound of the respective user's voice and providing a microphone input signal;

a second electronic device integral to the second headset; and a third electronic device integral to the third headset;

wherein the first electronic device is in communication with the second and third headsets through the respective second and third electronic device, the far-end voice signal received by the first electronic device includes voice output signals from both the second and third headsets, and the first far-end voice signal received by the first electronic device further includes the first voice output signal, and the first device is further configured to remove the first voice output signal from the first far-end voice signal before combining the first far-end voice signal with the first side-tone signal to generate the first combined output signal.

16. The system of claim 15, wherein the first and second headsets each include a noise cancellation circuit including a noise cancellation microphone for providing anti-noise signals to the respective electroacoustic transducer based on the noise cancellation microphone's output, and the first electronic device is configured to provide the first combined output signal to the first headset for output by the first headset's electroacoustic transducer in combination with the anti-noise signals provided by the first headset's noise cancellation circuit.

17. A portable system for enhancing communication between at least two users in proximity to each other, comprising:

first and second noise-reducing headsets, each headset comprising:

an electroacoustic transducer for providing sound to a respective user's ear, and a voice microphone for detecting sound of the respective user's voice and providing a microphone input signal;

a first electronic device integral to the first headset and in communication with the second headset, configured to:

generate a first side-tone signal based on the microphone input signal from the first headset, generate a first voice output signal based on the microphone input signal from the first headset, receive a first far-end voice signal from the second headset, combine the first side-tone signal with the first far-end voice signal to generate a first combined output signal, and provide the first combined output signal to the first headset for output by the first headset's electroacoustic transducer;

a second electronic device integral to the second headset, wherein the first electronic device is in communication with the second headset through the second electronic device, and the second electronic device is configured to:

generate a second side-tone signal based on the microphone input signal from the second headset, generate a second voice output signal based on the microphone input signal from the second headset, provide the second voice output signal to the first electronic device as the first far-end voice signal, receive the first voice output signal from the first electronic device as a second far-end voice signal, combine the second side-tone signal with the second far-end voice signal to generate a second combined output signal, and provide the second combined output signal to the second headset for output by the second headset's electroacoustic transducer; and a third noise-reducing headset, the third headset comprising:

an electroacoustic transducer for providing sound to a respective user's ear, and a voice microphone for detecting sound of the respective user's voice and providing a microphone input signal; and a third electronic device integral to the third headset, wherein the first electronic device is in communication with the third headset through the third electronic device, and the third electronic device is configured to:

generate a third side-tone signal based on the microphone input signal from the third headset, generate a third voice output signal based on the microphone input signal from the third headset, transmit the third voice output signal to the first and second electronic devices for use as the first and second far-end voice signals, receive the first voice output signal from the first electronic device and the second voice output signal from the second electronic device, combine the third side-tone signal with the first and second voice output signals as far-end voice signals to generate a third combined output signal, and provide the third combined output signal to the third headset for output by the third headset's electroacoustic transducer.

18. The system of claim 17 wherein the second electronic device is in communication with the third headset through the third electronic device.

19. The system of claim 17 wherein the second electronic device is in communication with the third headset through the third electronic device by way of the first electronic device.

20. A method of enhancing communication between at least two users of a portable communication system in proximity to each other, the portable communications systems comprising first and second noise-reducing headsets, each headset comprising:

an electroacoustic transducer for providing sound to a respective user's ear, and a voice microphone for detecting sound of the respective user's voice and providing a microphone input signal; and a first electronic device integral to the first headset and in communication with the second headset;

wherein the first electronic device is coupled directly to the second headset, the method comprising:

within the first electronic device, generating a first side-tone signal based on the microphone input signal from the first headset, generating a first voice output signal based on the microphone input signal from the first headset, combining the first side-tone signal with a first far-end voice signal associated with the second headset to generate a first combined output signal, and providing the first combined output signal to the first headset for output by the first headset's electroacoustic transducer;

within the first headset, transducing the first combined output signal into sound;

within the first electronic device, generating a second side-tone signal based on the microphone input signal from the second headset, generating the first far-end voice signal based on the microphone input signal from the second headset, combining the second side-tone signal with the first voice output signal to generate a second combined output signal, and providing the second combined output signal to the second headset for output by the second headset's electroacoustic transducer; and within the second headset, transducing the second combined output signal into sound.

21. A method of enhancing communication between at least two users of a portable communication system in proximity to each other, the portable communications systems comprising first and second noise-reducing headsets, each headset comprising:

an electroacoustic transducer for providing sound to a respective user's ear, and a voice microphone for detecting sound of the respective user's voice and providing a microphone input signal;

a first electronic device integral to the first headset and in communication with the second headset; and a second electronic device integral to the second headset, wherein the first electronic device is in communication with the second headset through the second electronic device, the method comprising:

within the first electronic device, generating a first side-tone signal based on the microphone input signal from the first headset, generating a first voice output signal based on the microphone input signal from the first headset, combining the first side-tone signal with a first far-end voice signal associated with the second headset to generate a first combined output signal, and providing the first combined output signal to the first headset for output by the first headset's electroacoustic transducer;

within the first headset, transducing the first combined output signal into sound;

within the second electronic device, generating a second side-tone signal based on the microphone input signal from the second headset, generating a second voice output signal based on the microphone input signal from the second headset, providing the second voice output signal to the first electronic device as the first far-end voice signal, receiving the first voice output signal from the first electronic device as a second far-end voice signal, combining the second side-tone signal with the second far-end voice signal to generate a second combined output signal, and providing the second combined output signal to the second headset for output by the second headset's electroacoustic transducer; and within the second headset, transducing the second combined output signal into sound.

* * * * *